US009895791B2

(12) United States Patent
Bleier

(10) Patent No.: US 9,895,791 B2
(45) Date of Patent: Feb. 20, 2018

(54) SHAPING APPARATUS FOR FINISHING SURFACES

(71) Applicant: Larry P. Bleier, Endicott, NY (US)

(72) Inventor: Larry P. Bleier, Endicott, NY (US)

(73) Assignee: Cutting Edge Technology, Endicott, NY (US)

( * ) Notice: Subject to any disclaimer, the term of this patent is extended or adjusted under 35 U.S.C. 154(b) by 0 days.

(21) Appl. No.: 15/241,252

(22) Filed: Aug. 19, 2016

(65) Prior Publication Data

US 2017/0066109 A1 Mar. 9, 2017

Related U.S. Application Data

(63) Continuation of application No. PCT/US2015/041998, filed on Jul. 24, 2015.

(60) Provisional application No. 62/029,329, filed on Jul. 25, 2014.

(51) Int. Cl.

| | |
|---|---|
| ***B24D 15/02*** | (2006.01) |
| ***B24D 15/06*** | (2006.01) |
| ***B24D 15/08*** | (2006.01) |

(52) U.S. Cl.

CPC ..... *B24D 15/02* (2013.01); *B24D 15/066* (2013.01); *B24D 15/08* (2013.01)

(58) Field of Classification Search

CPC ..... B24D 15/02; B24D 15/066; B24D 15/08
USPC ..... 451/45
See application file for complete search history.

(56) References Cited

U.S. PATENT DOCUMENTS

| | | | | | |
|---|---|---|---|---|---|
| 512,382 | A * | 1/1894 | Miller et al. | A63C 11/06 | 451/45 |
| 1,041,631 | A * | 10/1912 | Johnson | B24D 15/081 | 451/45 |
| 3,497,932 | A * | 3/1970 | Freehauf | B23K 11/3063 | 407/29.1 |
| 3,691,700 | A * | 9/1972 | Hayes | B24D 15/08 | 451/549 |
| 3,989,079 | A * | 11/1976 | Treadway | B24D 15/02 | 30/494 |
| 4,815,240 | A * | 3/1989 | Larson | B24D 15/066 | 451/555 |

(Continued)

OTHER PUBLICATIONS

International Search Report dated Sep. 10, 2015 from corresponding International Patent Application No. PCT/US2015/041998, 5 pages.

(Continued)

*Primary Examiner* — George Nguyen
(74) *Attorney, Agent, or Firm* — Ohlandt, Greeley, Ruggiero & Perle, L.L.P.

(57) ABSTRACT

The invention relates to finishing metallic and non-metallic surfaces by abrasion techniques. In certain embodiments, the invention pertains to an apparatus configured for finishing a zone on the surface of a bladed article of manufacture, wherein the apparatus comprises one or more channels having a cross-sectional profile including at least one finishing area to finish an operative zone of the article that optimizes a clearance portion of the article, wherein an angle of each finishing area of the cross-sectional profile is substantively the same as an optimal clearance angle of the article, wherein the apparatus is configured to position the operable zone of the article along the angle of the finishing area during sharpening.

25 Claims, 30 Drawing Sheets

(56) References Cited

U.S. PATENT DOCUMENTS

| | | | | | |
|---|---|---|---|---|---|
| 5,431,597 | A * | 7/1995 | Anderson | B24D 15/066 | 451/45 |
| 5,445,050 | A | 8/1995 | Owens | | |
| 5,520,574 | A | 5/1996 | Wilson | | |
| 5,582,535 | A * | 12/1996 | Friel | B24D 15/068 | 451/321 |
| 6,074,293 | A * | 6/2000 | Bleier | B24D 15/06 | 451/321 |
| 2001/0029670 | A1* | 10/2001 | Raklovits | B24D 15/08 | 30/123 |
| 2004/0105959 | A1* | 6/2004 | Pearsall | B24D 15/06 | 428/143 |
| 2005/0142992 | A1 | 6/2005 | Kawata | | |
| 2007/0178816 | A1* | 8/2007 | Lin | B60S 1/0483 | 451/523 |

OTHER PUBLICATIONS

Written Opinion dated Sep. 10, 2015 from corresponding International Patent Application No. PCT/US2015/041998, 7 pages.

* cited by examiner

Negative Rake Angle

Fig. 14B
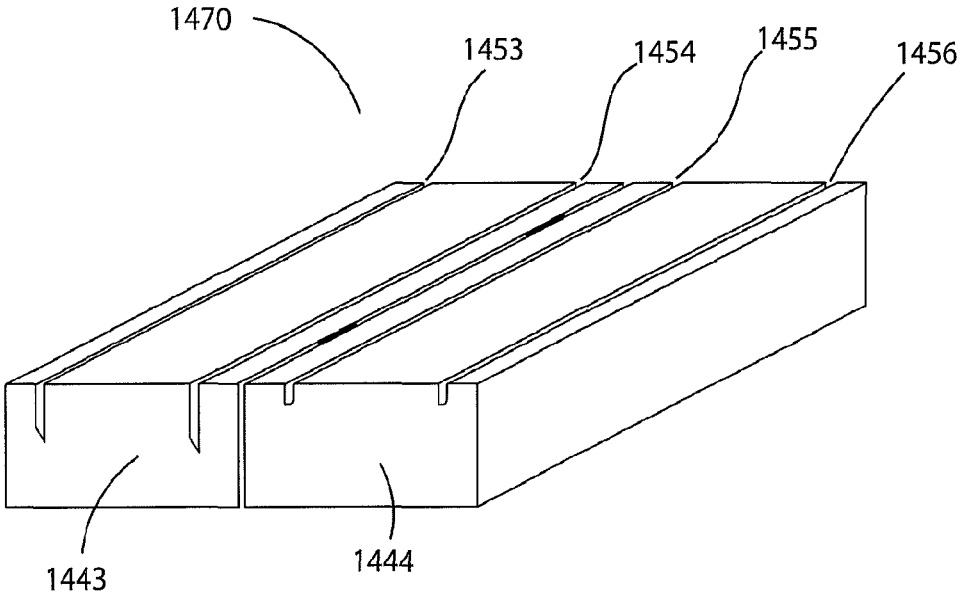
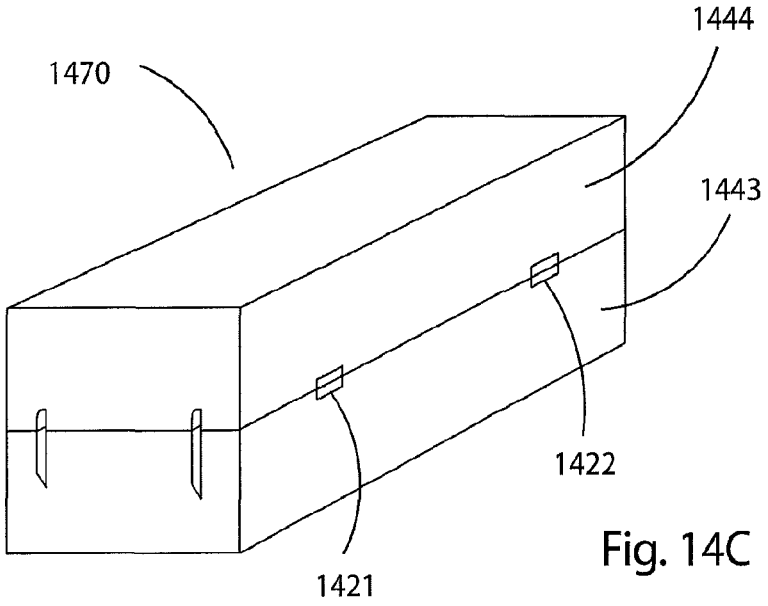
Fig. 14C

Fig. 15C
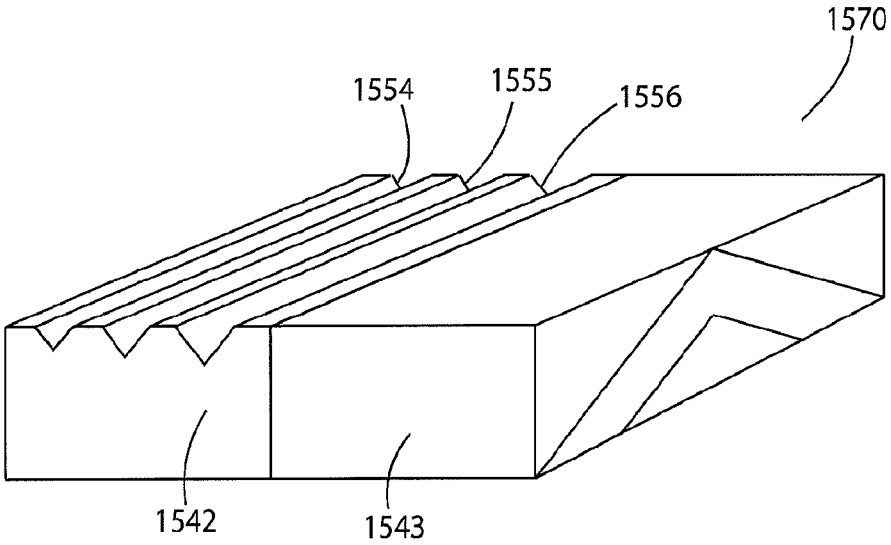
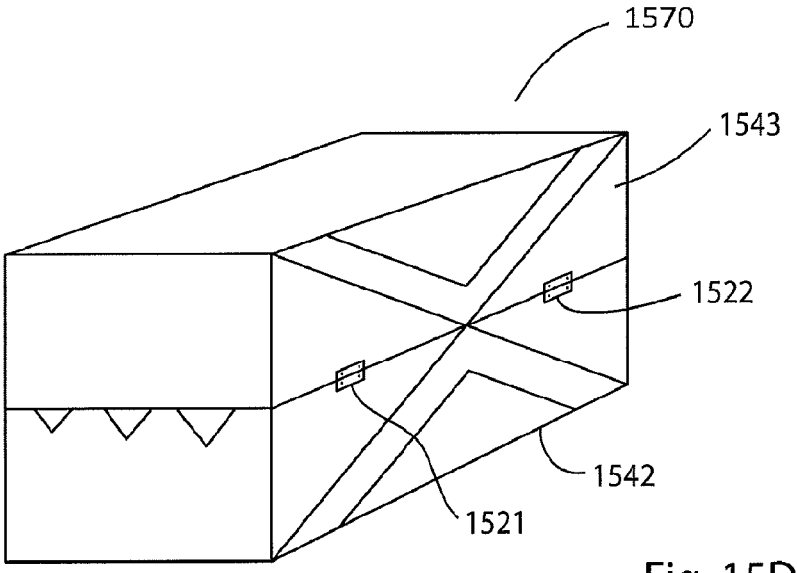
Fig. 15D

SHAPING APPARATUS FOR FINISHING SURFACES

CROSS-REFERENCE TO RELATED APPLICATION

This application claims the benefit of priority of U.S. Provisional Application Ser. No. 62/029,329, filed Jul. 25, 2014 and International Application Serial Number PCT/US/2015/041998 filed Jul. 24, 2015. The foregoing applications are each incorporated herein by reference in their entirety.

FIELD OF THE INVENTION

The invention relates to finishing metallic and non-metallic surfaces by abrasion techniques.

DESCRIPTION OF RELATED ART

The literature is replete with descriptions of apparatuses and methods for finishing the surfaces of a variety of articles of manufacture. Representative of such articles are tools and instruments, many having complex geometric shapes and curvilinear surfaces.

One of the problems in finishing complex surfaces, especially curvilinear surfaces, is the need to draw the article across an abrasive surface while continuously changing the angle so as to accommodate the geometric shape thereof. The finishing of complex surfaces usually requires skilled hands and experienced craftspeople. Even experts find it difficult to follow many complex surface shapes, due to the demanding control required.

In the manufacturing industry, establishing conditions for a finishing process to obtain a specified surface topography is also not problem free, since many interacting factors are involved. Under ideal circumstances, the factors to be considered involve the operational setting of the machine (e.g., the geometric characteristics of the abrasive tool, the work speed, the tool feed rate and the type of cutting fluid used). Even under ideal conditions it has been only possible to calculate the theoretical roughness developed in a machining operation for the simplest process, i.e., single-point tool cutting. The fact that it is not possible to fully specify the character and surface roughness scale and topography of a surface remains a serious problem for production/design engineers.

SUMMARY

Disclosed is an apparatus for finishing a zone on the surface of a bladed article of manufacture, said surface comprising a plurality of adjacent and contiguous zones, comprising a support for a rigid abrasive surface; one or more channels supported on the support, each of the channels having a cross-sectional profile including at least one finishing area to finish an operative zone of the article that optimizes a clearance portion of the article, wherein the finishing areas includes a contacting area and a non-contacting area, and wherein an angle of each finishing area of the cross-sectional profile is substantively the same as an optimal clearance angle of the article, wherein the apparatus is configured to position the operable zone of the article along the angle of the finishing area during sharpening.

In certain embodiments, each of the channels includes a pair of the finishing areas. The abrasive surface can further comprise a relief connecting the pair of sharpening areas and being positioned below the pair of sharpening areas, the relief corresponding to the zone or zones to remain unfinished. A finishing area can be a linear surface or curvilinear surface.

In certain embodiments, the clearance angle $\beta$ of the article is calculated as $\beta=90°-\gamma-\alpha$, where $\alpha$ is rake angle and $\gamma$ is blade angle.

In some embodiments, the support can be a block. In some embodiments, the abrasive surface comprises aluminum oxide. The support and the abrasive surface can comprise the same materials. In other embodiments, the support and the abrasive surface comprise different materials. The abrasive surface can be an exposed surface of the support. The finishing areas of the apparatus can be configured to finish a bladed article of manufacture selected from the group of: medical devices, kitchen knives, mower blades, dental curets, orthopedic curets, neurosurgical curets, ice skates, scissors (including, for example, hairdresser's scissors, surgical scissors, garden scissors, etc.) and wood planing instruments.

Disclosed is a method for finishing a zone on the surface of a bladed article of manufacture, said surface comprising a plurality of adjacent and contiguous zones, comprising: positioning an operable zone of the article in one channel on a support for a rigid abrasive surface of the article; and drawing the article through the channel, wherein one or more channels are supported on the support, each of the channels having a cross-sectional profile including at least one finishing area to finish an operative zone of the article that optimizes a clearance portion of the article, wherein the finishing areas includes a contacting area and a non-contacting area, and wherein an angle of each finishing area of the cross-sectional profile is substantively the same as an optimal clearance angle of the article, wherein the apparatus is configured to position the operable zone of the article along the angle of the finishing area during sharpening and shaping.

BRIEF DESCRIPTION OF THE DRAWINGS

FIGS. 14B and 14C show perspective views of another example of a scissors sharpening apparatus.

FIG. 14E shows a cross-sectional view of a groove of the scissors sharpening apparatus shown in FIG. 14B.

FIGS. 15C and 15D show perspective views of another example of a V-parting tool sharpening apparatus.

DETAILED DESCRIPTION OF EMBODIMENTS

Figure 1:
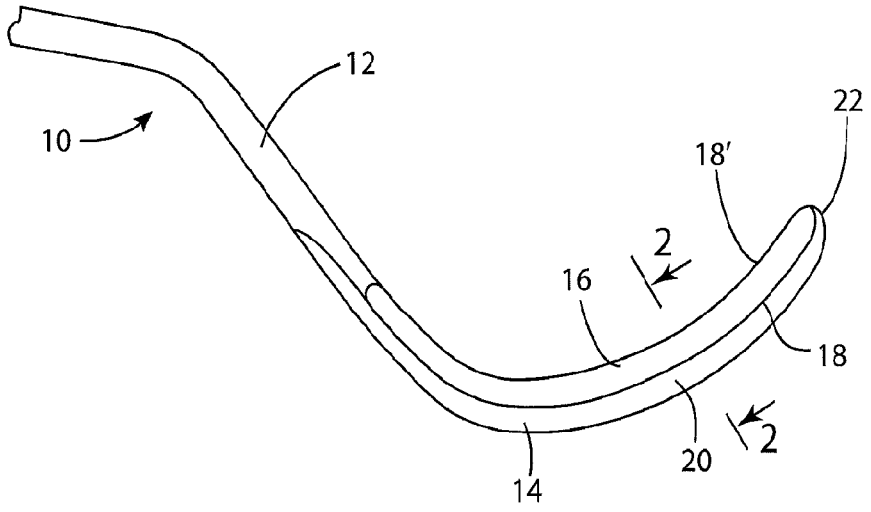
FIG. 1 is a side view of the blade end of a Gracey curet.

It is to be understood that the figures and descriptions of embodiments of the invention have been simplified to illustrate elements that are relevant for a clear understanding of the present invention, while eliminating, for purposes of clarity, many other elements that are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

Described is an apparatus that accurately provides an exactly shaped cutting edge to a bladed instrument. The apparatus not only provides an exact shape for the bladed instrument's cutting edge, but it does so with precision every time. Described herein are embodiments for a finishing apparatus and finishing process for shaping, sharpening, and surface roughness control for bladed instruments. Bladed instruments include, without limitation, medical instruments (e.g., curets such as dental, orthopedic, or neurosurgical curets), kitchen knives, lawn mower blades, ice skates, saws, screws, wood gouges, and wood planing instruments.

In certain embodiments, the finishing apparatus is configured such that drawing the instrument, a dental curet for example, across an abrasive surface of the apparatus eased. Although the instrument itself is generally held at certain angles with respect to the abrasive surface, even this is not critical. The apparatus has one or more specifically shaped abrasive surfaces to guide and finish the instrument surface. These abrasive surfaces create an exact shape for the cutting edge of the curet. The shape provides the fineness and delicacy of its original design. Therefore, the abrasive surface component of the apparatus creates not only an exact shape of the desired cutting edge of a curet, but a cutting edge with the proper edge fineness and delicacy required in dentistry based on current research.

In embodiments, the finishing apparatus is configured to include a honing guide to draw the instrument at a correct angle with respect to the abrasive surface. As noted above, the apparatus can have one or more specifically shaped abrasive surfaces to guide and finish the instrument surface. In another embodiment, the guide can be a separate element or feature, which may or may not be adjustable, to guide a bladed instrument at a predetermined angle, as for example where the angle for a given tool (e.g. curet, scissors, etc.) is known.

One aspect relates to the finishing of surfaces on tools and instruments. For example, dental, veterinary and medical instruments may have sophisticated shapes that can only be obtained with an exacting and complex finishing procedure. Although described using a dental curet as an example, the present invention is, however, not limited to the finishing of tools and instruments for use in the medical, dental and veterinary arts. Embodiments as described herein reflect the discovery that many surfaces can be carefully finished, shaped or sharpened to obtain the objectives required. This may be carried out by placing them in contact with abrasive surfaces that mirror completely, or partially and selectively, the desired surfaces of the objects to be finished. The present invention will aid in achieving the objectives of a specified manufacturing process (for example, surface topography or surface geometry, cross-sectional geometry, and surface finishing) by providing an apparatus having abrasive surfacing contours that have selectively planned abrading contact areas and relief surfaces (non-contacting areas) to permit a desired outcome of a finishing process. By controlled movements of the tool or instrument, or part thereof through the apparatus, one can impart a specific finish such as shaping, grinding, polishing, cleaning, buffing or sharpening to selected surface zones, while leaving other zones unfinished.

In some embodiments, a single tool may be configured to sharpen multiple different bladed instruments by configuring a single finishing apparatus and finishing process with surface topography or surface geometry, cross-sectional geometry, and surface finishing for shaping, sharpening, and surface roughness control for a plurality of bladed instruments (e.g., one area for a dental curet, one area for a scaler, one area for surgical scissors, etc.).

Those ordinarily skilled in the art will gain an appreciation of the invention from a reading of the following description of the embodiments viewed with the drawings of the accompanying FIGS. 1-16. The apparatus can be advantageously used to finish the surfaces of curvilinear shaped surfaces.

Described herein are embodiments for a finishing apparatus and finishing process for shaping, sharpening, and surface roughness control for one or more bladed instruments. Bladed instruments include, without limitation, medical instruments, kitchen knives, lawn mower blades, orthopedic curettes, neurosurgical curettes, ice skates, scissors, saws, screws, gouges, and wood planing instruments.

In the dental, veterinary and medical arts, sharp, well maintained, and properly shaped instruments provide better performance. This is universally true regarding each and every medical, veterinary, or dental instrument having a cutting or probing edge. Embodiments described herein are advantageous for use in finishing cutting surfaces of medical, veterinary, and dental instruments. For example, dental scaling instruments, some of which have long, curved cutting edges, such as curets, need to be sharpened frequently in order to function for proper tooth and root scaling in the efficacious removal of bacterial plaque, calculus (tartar deposits), and necrotic and/or diseased cementum from the surfaces of teeth crowns and their roots. The sharpening of the curved edge of the scaling tool produces a scaling surface that more readily and easily removes scale from a tooth, and also, the creation of the smoothest possible surface and shape of the treated tooth root defined in the dental literature as root planing. Scale removal can be improved by a controlled finishing of a tool with refined cutting edges; scale removal can also be accomplished with the exertion of less pressure. Such finishing also results in providing a dentist or technician with an increase in tactile sensitivity, dexterity, and control of the instrument. These instruments are placed below the gingiva and especially between adjacent tooth surfaces and when out of visual contact, there is a required dependency on increased tactile sensitivity for their use.

Likewise, reshaping and refinishing implant surfaces to restore, improve, or change their original three-dimensional topography and surface roughness can be improved by controlled finishing and refinishing of implant surfaces in vivo with a tool that has been sharpened or shaped according to the instant invention. Among other things, this is important because, for example, unlike the epithelia that line the oral cavity and provide an efficient defense mechanism against microbial growth due to their fast turnover (shedding three times per day), implants and other medical devices with non-shedding surfaces serve as a platform for the uncontrolled accumulation and/or metabolism of bacteria resulting in the development of a biofilm. Biofilm formation can lead to dental caries, gingivitis, periodontitis, peri-implantitis, and stomatitis. (See Teughels, W et al. Clin Oral Implants Res (2006) 17 Suppl 2: 68-81.) Therefore, instruments capable of more effectively preventing and controlling biofilm formation on implants and other medical devices with non-shedding surfaces are needed. Accordingly, in certain embodiments, the sharpening and finishing of a tool by use of an apparatus as described herein enables the reshaping and refinishing of a medical device surface to a smoothness that is less hospitable to microbial growth. For example, the subgingival environment better enables the survival of microorganisms, but a smoother surface on a dental tooth root or implant serves to minimize plaque formation and reduce the development of caries and periodontitis. (See Quirynen, M and Bollen, C M J Clin Periodontol (1995) 22(1):1-14.)

In some circumstances, the surface roughness of a natural tooth or dental implant or other device renders it conducive for the selective growth of certain biofilms. Similarly, in certain instances, the surface roughness of a dental implant or other device can promote healthy tissues or cellular growth, such as bone cells. Accordingly, in certain embodiments, an apparatus of the instant invention sharpens, shapes, and finishes a bladed article of manufacture to a desired roughness or smoothness at the cutting edge of the article such that it imparts a specified surface roughness to an object, such as a dental implant or natural tooth, to be finished by the article. In some embodiments, the article imparts a specified surface roughness to an object to allow for substances such as paints, adhesives, or other compounds that require certain roughness levels (e.g., in microns) to attach to the object.

Dental scalers are usually sharpened and shaped on a flat stone with a repeated reciprocal stroking, in a fashion that is similar to sharpening a knife blade. The difference, however, between the procedure of sharpening a knife blade and that of sharpening and shaping a dental scaling instrument is the degree of exercised control required in order to produce the optimum, i.e., the proper surface finish. In providing a keen edge for a curet, the exact angle at which the instrument contacts the sharpening stone is critical. For purposes of this description, the word "curet" is used to refer to all medical and dental instruments in the class, including, but not limited to, curets or "curettes," scalers, hoes, files, sickles, explorers, and the like. As will be appreciated, any tools requiring precision sharpening and shaping can also be sharpened and shaped using embodiments of the invention so configured, including knives, scissors, hoes, files, and so on without limitation.

FIG. 1 is a side view of a blade end of a Gracey curet as a representative dental scaling instrument, the curet 10 has a shank 12, and a distal or blade end having a back 14, a face 16 and a cutting edge 18 delineated by the angular meeting between face 16 and lateral surface 20. The edge 18 terminates at the toe 22, or, if rounded at terminus, continues onto edge 18.

Figure 2:
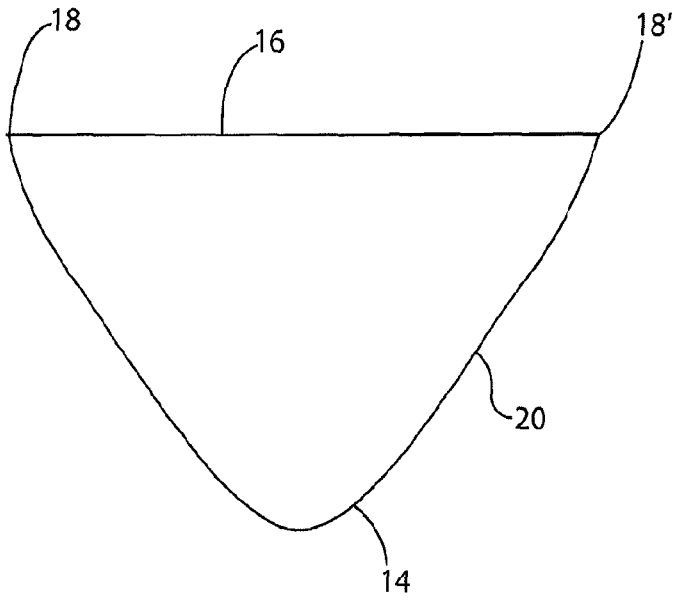
FIG. 2 is a cross-sectional view along lines 2-2 of FIG. 1.

FIG. 2 is a cross-sectional view of the blade along lines 2-2 of FIG. 1, illustrating further details of the curet 10 structure. As shown in FIG. 2, a second cutting edge 18' is delineated at the boundary between lateral surface 20 and face 16. The lateral surface 20 is curvilinear, and forms a part of a circle or ellipse. For purposes of illustration, the cutting edges 18 and 18' are shown as sharp and angular at the juncture of face 16 and the lateral surface 20. When the cutting edges 18 and 18' at their juncture with surface 20 are flattened from clinical use, a condition of dulling exists. To restore a sharp cutting edge 18 or 18', the lateral surface 20 must be abraded away to recreate the original clearance angle. It will be appreciated that, as described above, the curvature of surface 20 is critical if the original shape of the curet 10 is to be conserved while finishing and restoring the cutting edges 18 or 18' in sharpness. This is accomplished readily and easily using the apparatus of the invention.

Clearance is the space between a substrate and the side of a blade or other instrument immediately behind the cutting edge of the instrument when it is in function against the substrate. The two surfaces involved, namely, the substrate and the instrument side behind the cutting edge of the instrument, form an angle measured in degrees. This angle is known as the clearance angle. (See also, e.g., Paquette, O E and Levin, M P J Periodontol (1977) 48(3):163-168, incorporated herein by reference.) As used herein, a "substrate" is any object, structure, or material surface that contacts the cutting edge of a bladed tool, object, structure, or other bladed instrument. "Cutting" is cleavage, or the separation of discrete parts along natural lines of division, and there are different modes of cutting, such as: (1) slicing, (2) tearing, and (3) wedging (see Paquette and Levin, page 163, right column, second full paragraph). The cutting edge of a bladed instrument is the cutting surface of the instrument.

Proper clearance is important if the edge is to make contact with enough pressure and precision to take full advantage of rake and fineness. Where there is insufficient clearance, force used in pressing the blade against the substrate is dissipated over the entire area of contact instead of being concentrated at the cutting edge where it belongs. Thus, for example, scaler edges lacking adequate clearance must be pressed against a tooth with proportionately greater force than correctly adjusted instruments to produce a comparable effect.

Figure 3A:
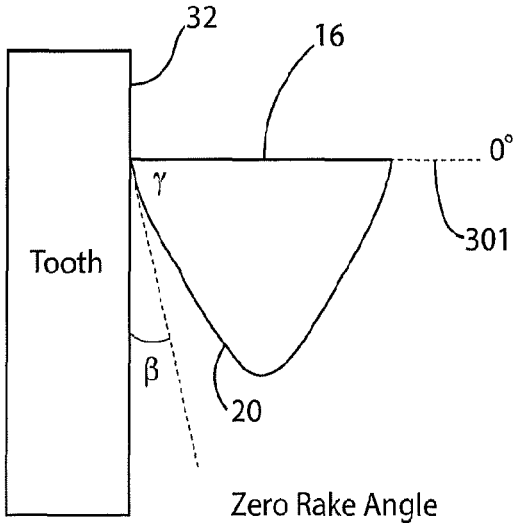
FIG. 3A-3C are cross-sectional views of the blade and tooth illustrating rake and clearance angle.
Figure 3B:
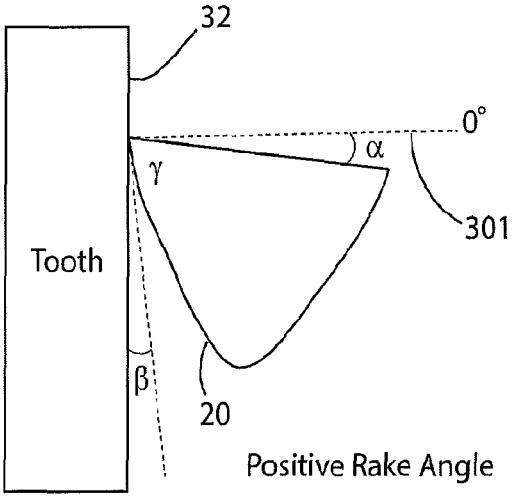
Figure 3C:
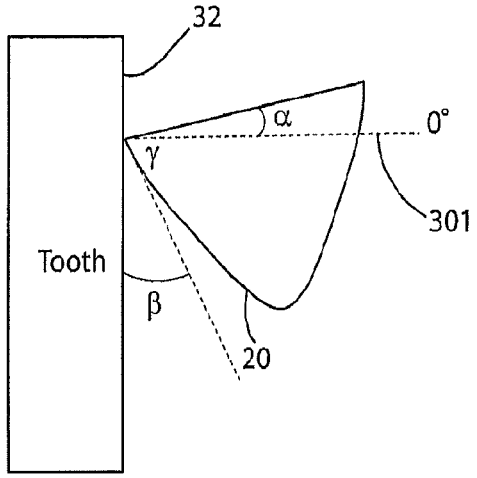

FIGS. 3A-3C are cross-sectional views of a blade and tooth illustrating a rake and clearance angle. Cutting efficiency of the curet is mainly determined by the rake and clearance angle. As shown in FIGS. 3A-3C, rake angle α is formed by the face of the blade 16 and the plane 301, which is perpendicular (90°, −90°) to the tooth surface 32. For example, in FIG. 3A the rake angle is defined as zero rake. In FIG. 3B, when the rake angle is measured below the plane 301, the rake angle is defined as positive rake. In FIG. 3C, when the rake angle is measured above the plane 301, the rake angle is defined as negative rake. A preferred rake angle is zero or slightly positive, since a positive rake angle tends to dig in and grip easily and securely. A negative rake angle can cause the blades to ride over the surface rather than cutting it.

Figure 4:
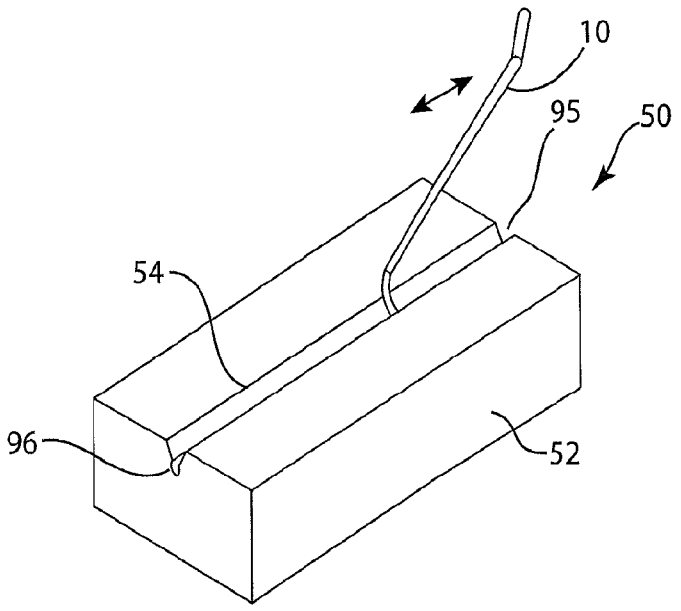
FIG. 4 is a view-in-perspective of one embodiment apparatus as seen from above.

The clearance angle β, as shown in for example FIGS. 3A-3C, is measured between the lateral surface 20 and the tooth surface 32. A proper clearance angle allows efficient cutting. As shown in FIGS. 3A-3C, clearance angle β may be calculated according to rake angle α and blade angle γ. For example, in FIGS. 3A-3C, clearance angle β may be calculated according to the following equations:

In FIG. 3*A*, clearance angle $\beta=90°-\gamma$;

In FIG. 3*B*, clearance angle $\beta=90°-\gamma-\alpha$;

In FIG. 3*C*, clearance angle $\beta=90°-(\gamma-\alpha)=90°-\gamma+\alpha$;

FIG. 4 is a perspective view of an apparatus 50, which is a finishing apparatus and more particularly is a sharpening and shaping device comprising a block 52 of hardened abrasive material designed to abrade the lateral surfaces 20 of a dental curet. This block 52 is a support means 40 containing one or more honing channels (for example, grooves 54) that finish the lateral surface 20 of a curet 10 when it is inserted into the appropriate groove 54 and drawn against the finishing area. As shown in FIG. 4, the blade end of curet 10 is inserted into groove 54. The groove 54 is lined with finishing area as described below. The apparatus 50 can be manufactured with different grooves corresponding to the different blade end shapes and tip sizes that are needed for various dental, veterinary, or medical instruments. Drawing the cutting edge of the curet 10 through a particular groove will impart with precision a particular shape to the end of the tool. The working edge of the instrument shaped by this invention will then be provided with a cutting edge that will approach and even improve upon the original precision of the original item.

Those ordinarily skilled in the art will appreciate from the description above of the apparatus of that in one embodiment, there is provided a finishing device for dental scaling instruments. The shaping and sharpening device is designed to restore and improve the original, precise sharpness and shape to the tip or blade of a bladed instrument. The sharpening and shaping device comprises a block of abrasive material such as ceramic or aluminum oxide. The block as a support means 40 comprises on its surface at least one groove having a specific, cross-sectional profile of finishing area 43.

The profile of the groove 54 may be widely varied, depending on the article to be finished and the surface zones to be finished while excluding or not touching contiguous zones of the surface that are to remain unfinished. For example, the conventional dental tool known as the curet has two different ends, each having a similarly shaped blade. The abrasive cross-sectional profiles of the apparatus allows for the sharpening and shaping of either end of a dental curet and does so whether the instrument is new or used and worn.

As will be appreciated, as most dental manufactures use "eye-hand precision" to make the lateral surfaces, e.g., 18, 18', the clearance varies from instrument to instrument, without true reproducible geometry as made possible by embodiments as disclosed herein.

In another embodiment, the apparatus can be configured to finish scissors, where single ended cutting edges and channel-grooves may have one abrasive wall, and a guiding wall.

Figure 5:
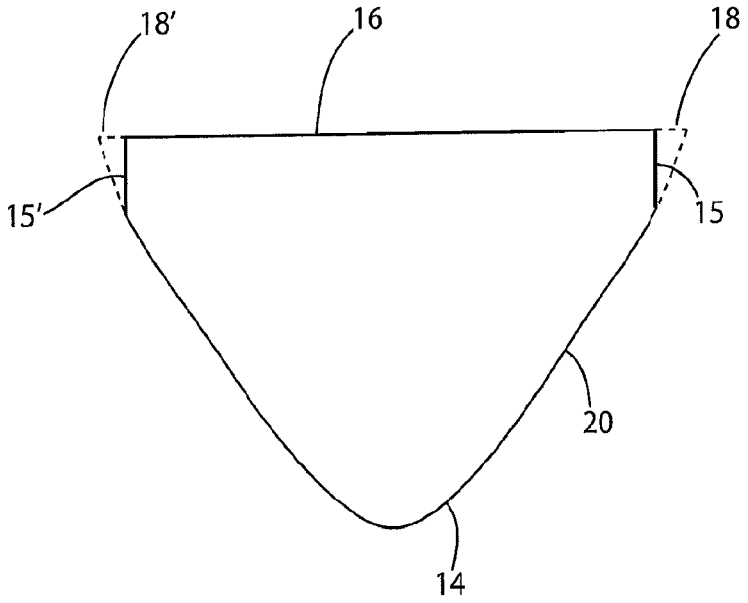
FIG. 5 is a cross-sectional view of a worn blade end of a curet.

FIG. 5 is a cross-sectional view of a worn blade. For purposes of illustration, in FIG. 5, the lateral surfaces 20 adjacent to edges 18, 18' are shown as flattened, i.e., dulled. The dashed line shows the original surface of the blade, and surfaces 15, 15' show the surfaces of the worn blade.

Figure 6:
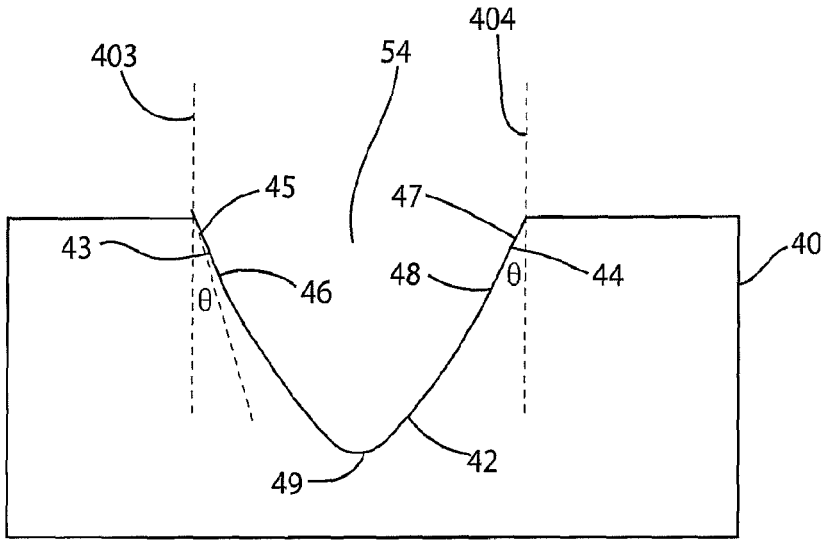
FIG. 6 is a cross-sectional view of a finishing apparatus.

FIG. 6 is a cross-sectional view of the finishing apparatus 50. The apparatus comprises a support means 40 for supporting a groove 54 that includes a pair of finishing areas, i.e., area 43 on the left side and area 44 on the right side. The finishing area angle θ is formed between the finishing areas 43, 44 and the planes 403, 404 that are perpendicular to the surface 41 of the support means 40, respectively. The finishing area angle θ is equal to the clearance angle β shown in FIGS. 3A-3C. For example, in FIG. 6, the finishing area angle θ is 30°. The finishing areas 43 or 44 are used to finish the operative zone of the curet 10. Each of the finishing areas 43, 44 includes a contacting area which contacts with the curet 10 during finishing, and a non-contacting area which may not contact with the curet 10 during finishing. For example, the finishing area 43 includes a contacting area 45 and a non-contacting area 46, and similarly, the finishing area 44 includes a contacting area 47 and a non-contacting area 48. As will be appreciated, the finishing areas 43, 44 may be linear or curvilinear surfaces. When the finishing areas 43, 44 are curvilinear surfaces, the finishing area angle θ is a curvilinear angle.

The portion 49 is a relief; corresponding to the zones to remain unfinished and not projecting towards the inserted curet 10 and therefore incapable of contact with any surface of the curet 10. In this way, during finishing of curet's 10 lateral surface 20, the back 14 of curet 10, which is a surface zone contiguous to lateral surface 20, remain unexposed to modification by finishing, and thus preserving the back from loss of metal through abrasion. The relief portion 49 may have a wide variety of cross-sectional side profiles, ranging from square to oval or elliptical. When the surface to be finished is linear or relatively flat, the relief portion 49 is advantageously below the cutting portions 43, 44. Where the article to be finished has a curvilinear surface, for example a curet 10, the relief portion 49 may be below or above the abrasive portions 43, 44.

Figure 7A:
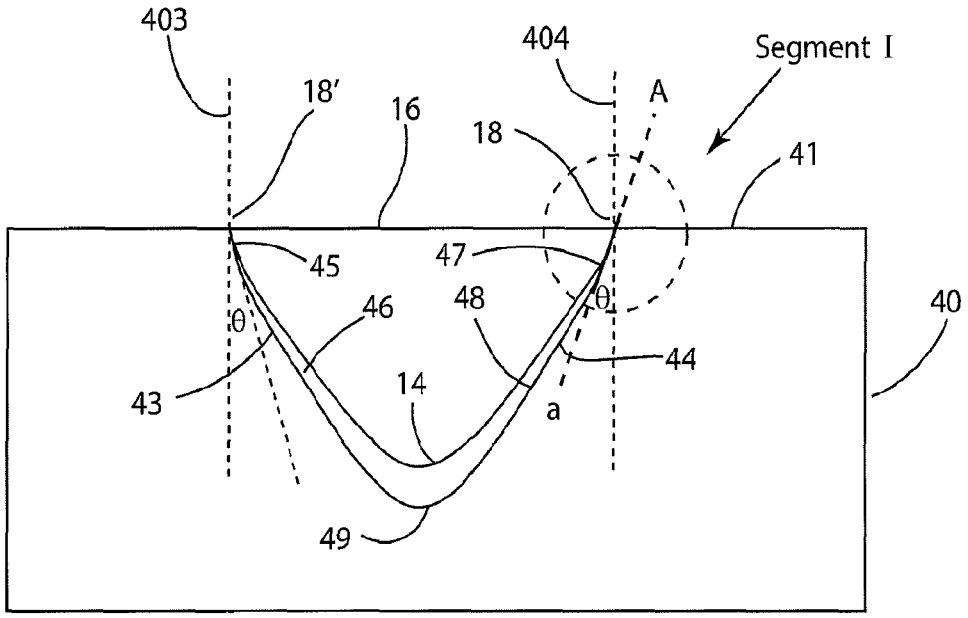
FIG. 7A is a cross-sectional view of the curet shown in FIGS. 1 and 2, positioned in the finishing apparatus shown in FIG. 6.

FIG. 7A is a cross-sectional side view of the curet shown in FIG. 5, positioned in the apparatus shown in FIG. 6.

Figure 7B:
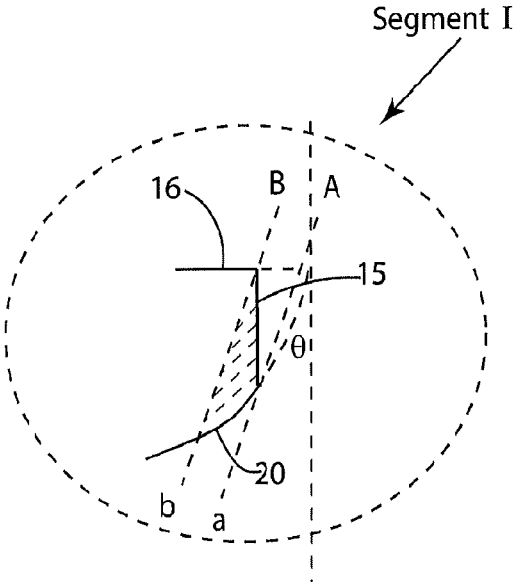
FIG. 7B shows an enlarged Segment I indicated by the circle in FIG. 7A.

FIG. 7B shows an enlarged Segment I indicated by the circle in FIG. 7A. The line A-a shows the surface of the finishing area 44. By abrading away portions of the lateral surface 20 to correspond to the profile of the finishing area, the surface of the blade is finished, as shown as Line B-b, such that the original, sharp condition is restored and even improved upon. As shown in FIG. 7B, the shaded portion will be abraded away by finishing area 44, thereby restoring the proper cutting edge 18 and configuration of the lateral surface 20, upon reciprocal motion of the curet 10 against finishing area 44. By moving the curet 10, lateral surface 20 adjacent to cutting edge 18 is brought into physical contact with finishing area 44, especially the contacting area 47 of the finishing areas 44, if one wishes to finish this cutting edge 18. If the blade face 16 of the curet 10 is parallel to surface 41, the curet can be finished in one movement against finishing area 43 and 44, since both contacting areas 45 and 47 will simultaneously contact with the lateral surface 20 adjacent to cutting edges 18' and 18, respectively.

Referring back to FIG. 4, the apparatus 50 of the invention may be operated as follows. For example, the tip or blade edge of a dull and/or worn curet 10 is sharpened and shaped by the apparatus of the invention by inserting the blade or tip of the curet into an appropriate groove 54 as illustrated in FIG. 4. The dentist or technician then proceeds to draw the tip of the curet 10 through the groove 54 in the directions shown by the arrow, using a steady force. Alternatively, the apparatus 50 may be moved and the curet 10 held steady. In this manner, the lateral surface 20 of the curet 10 is accurately shaped by the finishing area 43, 44. The relief portion 49 of the apparatus 50 provides non-abrasive clearance for specific selected surface areas of the curet 10 so as to avoid weakening by excessive unnecessary abrasion. The relief 49 of the apparatus correctly aids in the shaping of the instrument, which heretofore, could not be maintained when abraded across or against a flat abrasive surface.

The apparatus 50 has a generally flat upper surface and is made of hardened abrasive material to abrade select zones of metal surfaces on curet 10, thus sharpening and shaping it. The curet 10 is held by the dentist, while one of the respective two ends, is inserted and drawn through the appropriate groove 54, in order to sharpen and shape the blade or cutting edge of curet 10.

The curet 10 is generally held to correspond to the tip of the dental curet 10 to the particular shape of the groove 54, as described above in relation to FIG. 4. After the curet 10 is inserted into the groove 54, the tip is drawn linearly through the groove (arrow) of the block 52, thus imparting the proper shape and sharpness to the blade or tip end.

The block 52 may be generally fabricated from a hardened, abrasive material such as a ceramic, aluminum oxide or metal carbide (such as tungsten carbide). The block 52 may be manufactured by dry powder compaction techniques, or by extruding the material through a die, in which case the finishing area 43, 44 is an exposed surface of the abrasive block 52. In an alternate embodiment, block 52 may be fabricated from a plurality of different abrasive materials, so that the finishing area 43, 44 is a composite of different abrasive materials, each selected for its particular affect on article surfaces to be finished. For example, where a coarse abrasion is required, the corresponding negative image portion of finishing area 43, 44 may have a coarser abrasive than an adjacent zone where the corresponding surface portion of the article is only to be polished.

In some embodiments, the apparatus of the invention may be machine operated. For example, the tip or blade edge of a dull and/or worn instrument, such as a curet 10, is sharpened and shaped by an apparatus of the invention by inserting the blade or tip of the curet into an appropriate groove 54 as illustrated in FIG. 4, wherein the apparatus is configured for automated movement. For instance, instead of a dentist or technician drawing the tip of the curet 10 through the groove 54 in the directions shown by the arrow, the curet is inserted into a machine apparatus wherein the machine draws the curet 10 through the groove 54. Alternatively, the apparatus 50 may be moved by a machine and the curet 10 held steady. In this manner, the lateral surface 20 of the curet 10 is accurately shaped by the finishing area 43, 44. The relief portion 49 of the apparatus 50 provides non-abrasive clearance for specific selected surface areas of the curet 10 so as to avoid weakening by excessive unnecessary abrasion. The relief 49 of the apparatus correctly aids in the shaping of the instrument, which heretofore, could not be maintained when abraded across or against a flat abrasive surface.

In some embodiments, the apparatus includes a pivot in the base of the channel that facilitates pivoting the instrument to be shaped, such as a curet 10, within the apparatus as the instrument is moved against the abrasive surface. In certain further embodiments, the pivot is within a channel groove that serves as a track to draw the pivot along the channel. In some embodiments, the pivot stabilizes the instrument within the channel to permit the sharpening, shaping, and finishing of the instrument to a desired specification, such as restoration of the original clearance angle or the creation of a new desired clearance angle.

In certain embodiments, the apparatus may be used for finishing a zone on the surface of a skate blade. The design of the skate blade must be able to support a skater's quick acceleration, turns, and stops. This is accomplished by grinding a slight hollow into the bottom of the blade. This creates two sharp edges that "bite" into the ice, and prevent slipping.

Figure 8A:
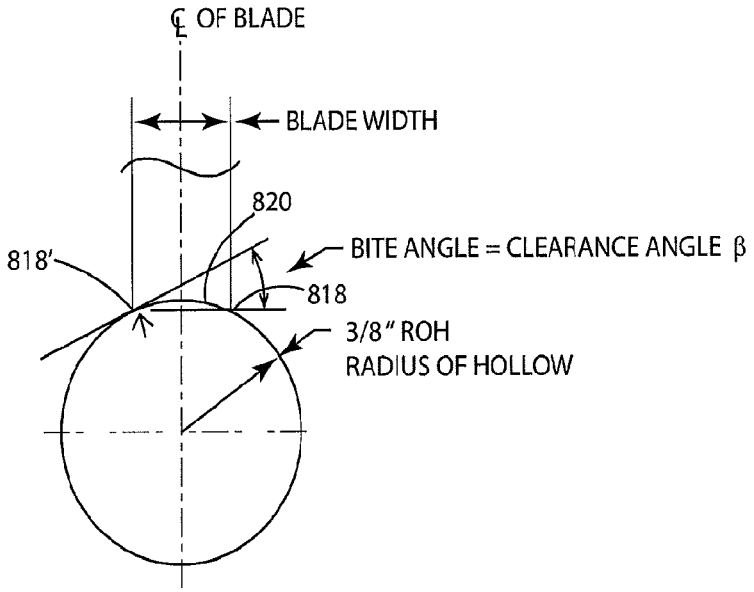
FIG. 8A is an example of a cross-sectional view of a skate blade.
Figure 8B:
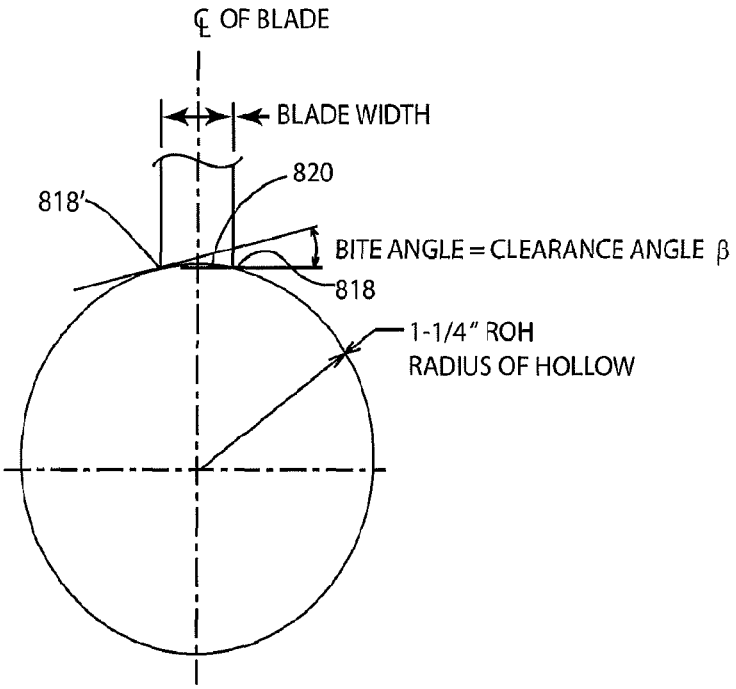
FIG. 8B is another example of a cross-sectional view of a skate blade.

FIG. 8A is an example of a cross-sectional view of a skate blade with ⅜ radius of hollow (ROH). FIG. 8B is another example of a cross-sectional view of a skate blade with 1¼ ROH. The clearance angle or bite angle β, as shown in for example FIGS. 8A-8B, is measured between the circular surface 820 and the plane formed by the two sharp edges 818 and 818'. A proper clearance angle allows efficient cutting. The radius of hollow may be ⅜", ½", ⅝", or 1", etc.

Figure 8C:
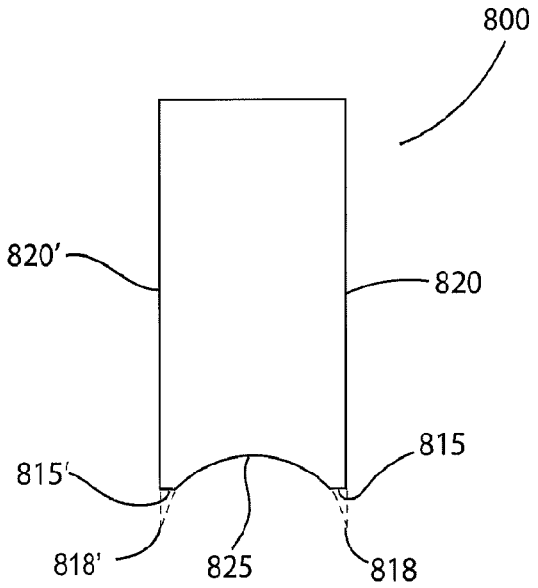
FIG. 8C is a cross-sectional view of a worn blade end of a skate blade.

FIG. 8C is a cross-sectional view of a worn blade end 800 of a skate blade. For purposes of illustration, in FIG. 8C, the lateral surfaces 820, 820' adjacent to edges 818, 818', respectively, are shown as flattened, i.e., dulled. The dashed line shows the original surface of the blade, and surfaces 815, 815' show the surfaces of the worn blade.

Figure 8D:
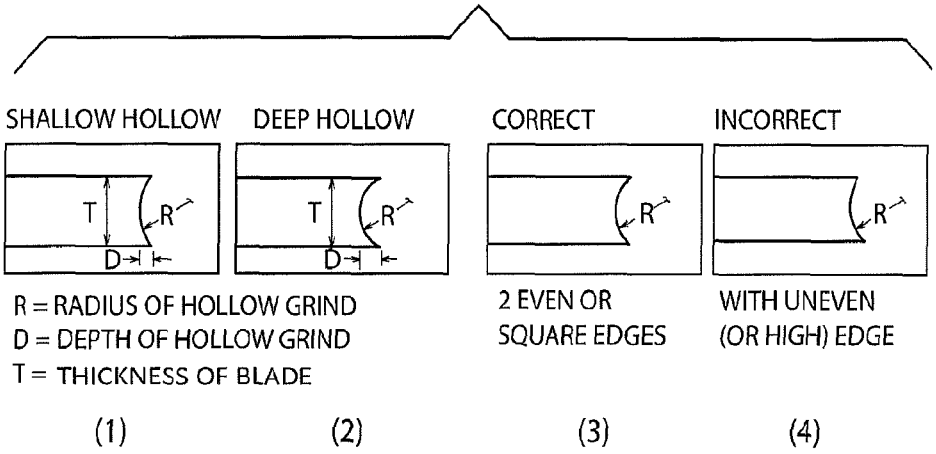
FIG. 8D shows cross-sectional views of skate blades.

FIG. 8D shows cross-sectional views of skate blades. A deep hollow (¼ or ⅜ths of an inch), as shown in FIG. 8D (2), allows for a more pronounced edge, which makes for tighter turns and more bite for stopping. A flat hollow (⅝ths, ¾, ⅞ths or an inch), as shown in FIG. 8D (1), is more conducive to a heavier skater. As shown In FIG. 8D (3), a properly sharpened skate has two equal and even edges. See www(dot)theskatetruck(dot)com/sharpening/, accessed Jul. 21, 2015.

Figure 9:
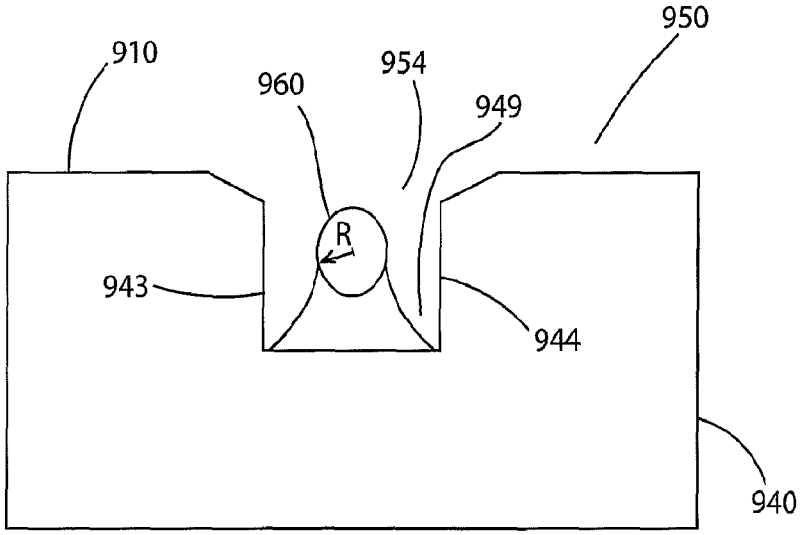
FIG. 9 is a cross-sectional view of a skate blade sharpening apparatus.

FIG. 9 is a cross-sectional view of a skate blade sharpening apparatus 950. The apparatus comprises a support means 940 for supporting a groove 954 positioned on the top surface 910 of the apparatus. The groove 954 includes a pair of sharpening areas, i.e., a first abrasive wall 943 on the left side and a second abrasive wall 944 on the right side. The abrasive walls 943 and 944 may be fully adjustable or non-adjustable.

The groove 954 also includes a circular surface 960 that has a radius R, which is the radius of hollow grind. The circular surface 960 may be an abrasive surface or non-abrasive surface. The radius R of hollow grind must be centered down the middle of the skate blade. The relief 949 can be rounded, rectangular, square, flat, or other shapes. The relief acts as a non-abrasive guiding wall. In some embodiments, the walls 943 and 944 are non-abrasive and fully adjustable or non-adjustable in order to act as guides for selectively restoring the appropriate ROH centered down the middle of the skate blade by an abrasive circular surface 960. In other embodiments, the circular surface 960 is non-abrasive and acts as a relief surface and/or guide when walls 943 and 944 are abrasive to shape the lateral surfaces 820 and 820' of the skate blade.

Figure 10A:
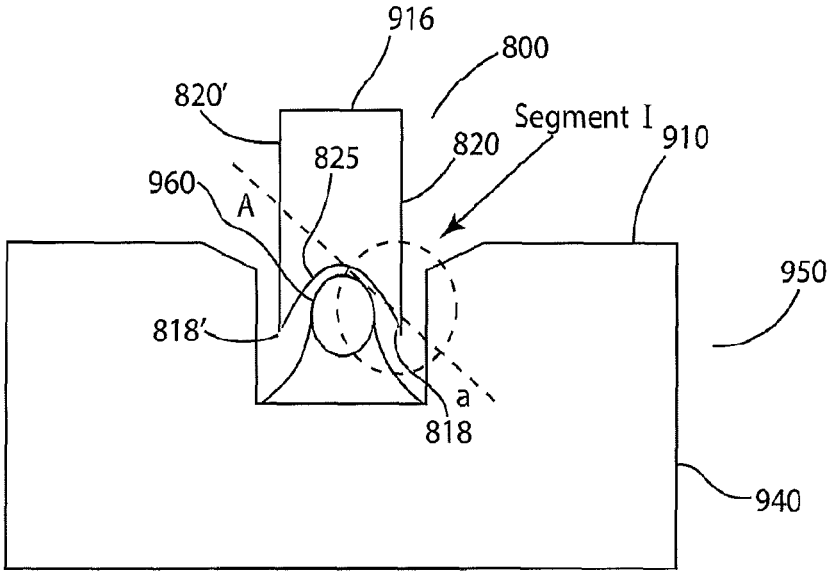
FIG. 10A is a cross-sectional view of the skate blade shown in FIG. 8C, positioned in the skate blade sharpening apparatus shown in FIG. 9.

FIG. 10A is a cross-sectional view of the skate blade 800 shown in FIG. 8C, positioned in the skate blade sharpening apparatus shown in FIG. 9.

Figure 10B:
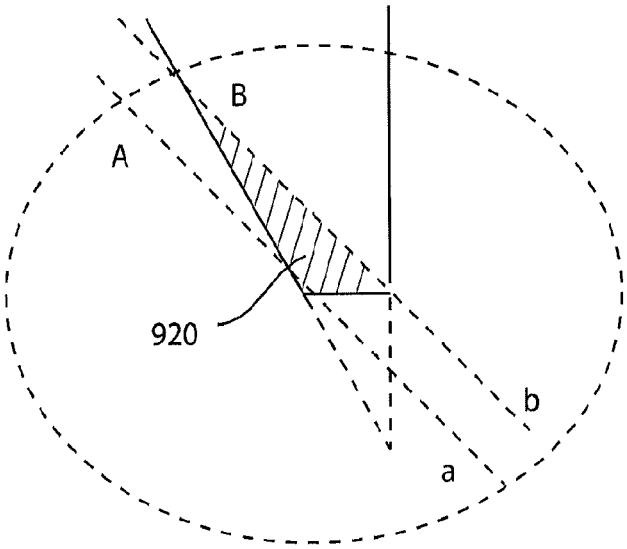
FIG. 10B shows an enlarged Segment I indicated by the circle in FIG. 10A.

FIG. 10B shows an enlarged Segment I indicated by the circle in FIG. 10A. The line A-a shows the surface of the circular surface 960. By abrading away portions of the lateral surface 825 to correspond to the profile of abrasive surface 960, the surface of the blade is finished, as shown as Line B-b, such that the original, sharp condition is restored and even improved upon. As shown in FIG. 10B, the shaded portion 920 will be abraded away by the abrasive surface 960, thereby restoring the proper cutting edge and configuration of the lateral surface 825, upon reciprocal motion of the skate blade 800 against abrasive surface 960. Also, by moving the skate blade 800, lateral surface 825 adjacent to cutting edges 818 and 818' is brought into physical contact with abrasive surface 960, if one wishes to finish the cutting edges 818 and 818'. If the skate blade face 916 is parallel to surface 910, the skate blade can be finished in one movement against abrasive surface 960, since the abrasive surface 960 will simultaneously contact with the lateral surface 825 adjacent to cutting edges 818' and 818, respectively.

Figure 11A:
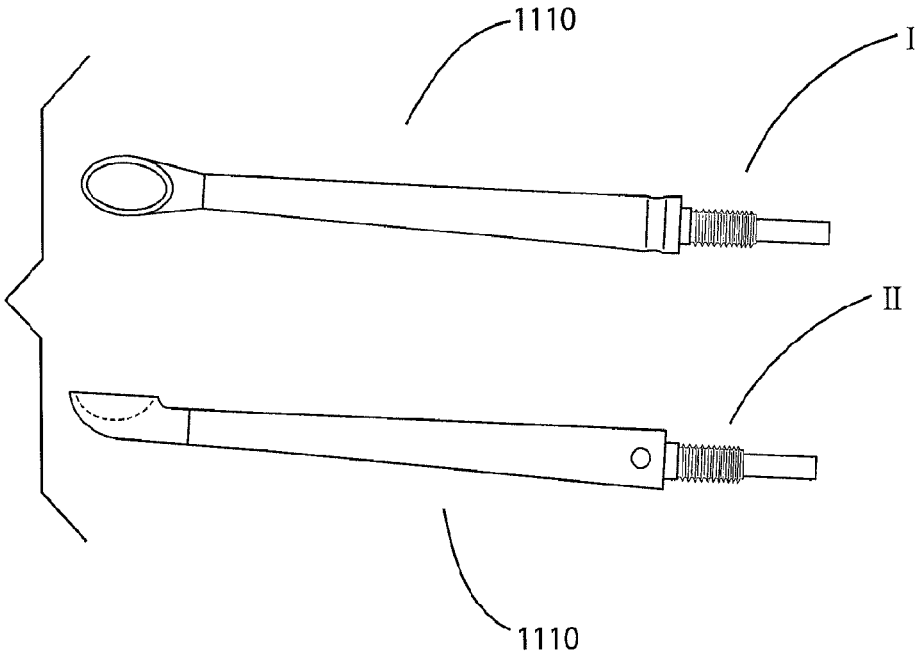
FIG. 11A illustrates an example of an orthopedic curet.

FIG. 11A illustrates an example of an orthopedic curet 1110. For example, a top view I and a side view II of the orthopedic curet 1110 are shown in FIG. 11A, respectively.

Figure 11B:
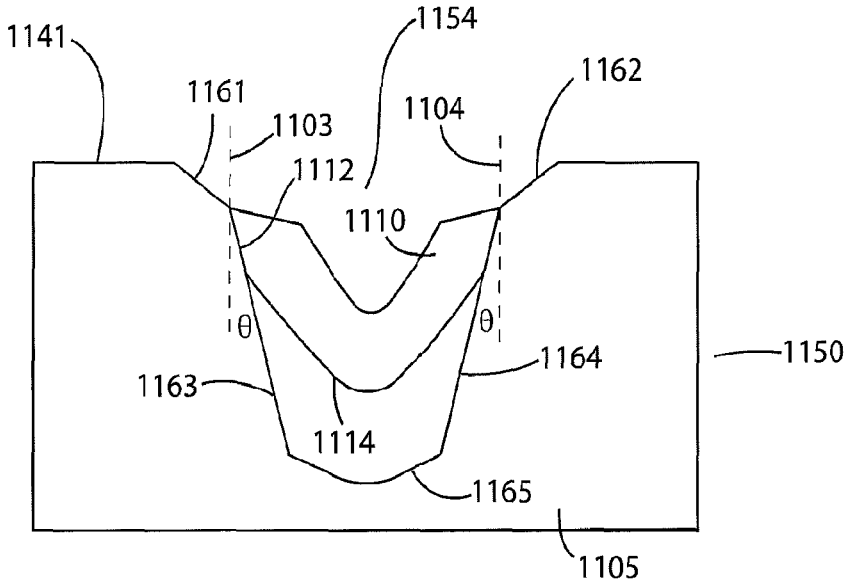
FIG. 11B illustrates an embodiment of a curet sharpening apparatus.

FIG. 11B illustrates an embodiment of a curet sharpening apparatus of the instant invention. FIG. 11B shows a cross-sectional view of the orthopedic curet 1110 shown in FIG. 11A, positioned in a curet sharpening apparatus 1150.

The orthopedic curet sharpening apparatus 1150 is a sharpening and shaping device comprising a block 1105 of hardened abrasive material designed to abrade the lateral surfaces of the orthopedic curet. The orthopedic curet sharpening apparatus 1150 contains one or more channels or grooves 1154 that contact the lateral surface 1112 of the orthopedic curet 1110 when it is inserted into the appropriate groove 1154 and drawn against the abrasive area. The apparatus 1150 can be manufactured with different grooves corresponding to the different orthopedic curet shapes and sizes. Drawing the cutting edge of the curet 1110 through a particular groove will impart with precision a particular shape to the end of the tool.

As shown in FIG. 11B, the groove 1154 has relief areas 1161 and 1162 on each side of the groove, respectively. Two abrasive areas 1163 and 1164 are located below the relief areas 1161 and 1162, respectively, on each side of the groove 1154. The portion 1165 is a relief corresponding to the zones to remain unfinished and not projecting towards the inserted orthopedic curet 1110 and therefore incapable of contact with any surface of the curet 1110. In this way, during the finishing of curet 1110 lateral surface 1112, the back 1114 of curet 1110, which is a surface zone contiguous to lateral surface 1112, remains unexposed to modification by finishing, and thus preserving the back from loss of metal through abrasion. The relief portion 1165 may have a wide variety of cross-sectional side profiles, ranging from square to oval or elliptical.

The relief portion 1165 may be designed to serve as a honing guide to control the orthopedic curet 1110 at the back 1114 during movement through the channel, and can allow pivoting around a horizontal or vertical axis, or elliptical movements.

In FIG. 11B, a finishing area angle θ is formed between the abrasive areas 1163, 1164 and the planes 1103, 1104 that are perpendicular to the surface 1141 of the orthopedic curet sharpening apparatus 1150, respectively. The finishing area angle θ is equal to the clearance angle β shown in FIGS. 3A-3C.

Figure 12A:
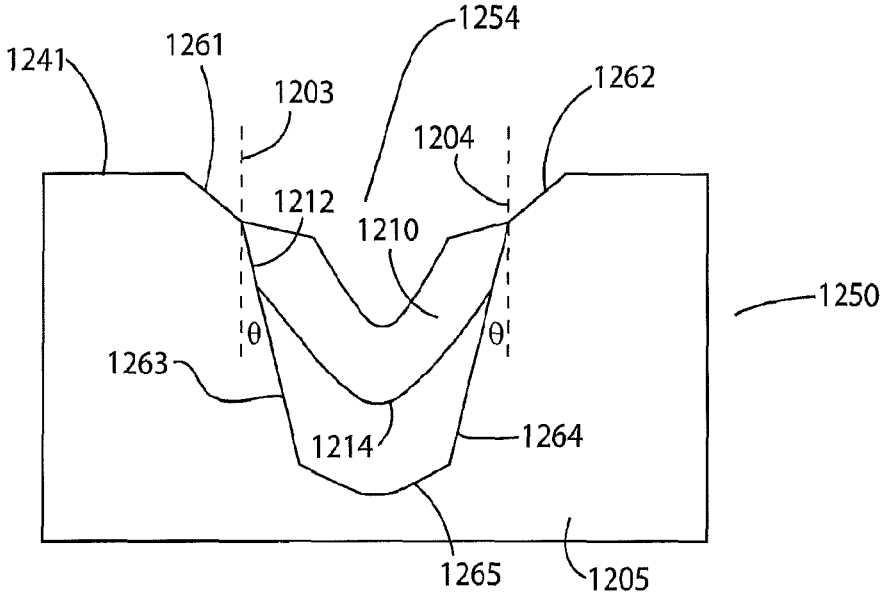
FIG. 12A illustrates another embodiment of a curet sharpening apparatus.

FIG. 12A illustrates another embodiment of a curet sharpening apparatus of the instant invention. FIG. 12A shows a cross-sectional view of the orthopedic curet 1210, which is same as the orthopedic curet 1110 shown in FIG. 11A, positioned in a curet sharpening apparatus 1250.

The orthopedic curet sharpening apparatus 1250 contains one or more channels or grooves 1254 that contact the lateral surface 1212 of the orthopedic curet 1210 when it is inserted into the appropriate groove 1254 and drawn against the abrasive area. Compared with the orthopedic curet sharpening apparatus 1150 shown in FIG. 11B, the orthopedic curet sharpening apparatus 1250 only has an abrasive area on one side, and the other side may be made of one or more elastic materials, such as, for example, rubber. As shown in FIG. 12A, in certain embodiments, the abrasive area 1263 is located on the left side of the groove 1254, and the right side is a rubber wall 1264. Relief areas 1261 and 1262 are located above the abrasive area 1263 and the rubber wall 1264, respectively, on each side of the groove 1254, and as in FIG. 11B can also have relief areas below curet 1210 at 1263, 1264 as at 1265 of groove 1254.

Figure 12B:
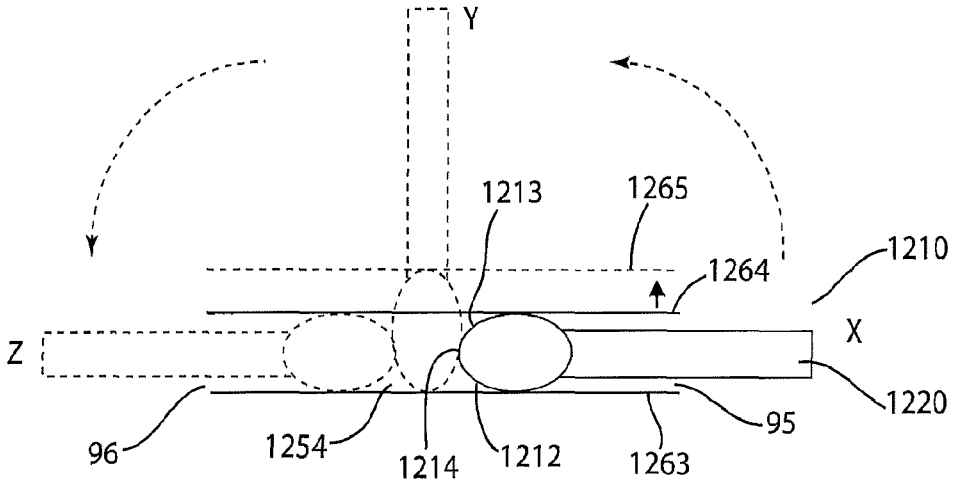
FIG. 12B shows a top view of the orthopedic curet positioned in the curet sharpening apparatus.

FIG. 12B shows a top view of the orthopedic curet 1210 positioned in the groove 1254 of the curet sharpening apparatus 1250. During the finishing of curet 1210, first, the curet is inserted in the groove 1254 at position X. The user draws the curet along the groove 1254, so that the lateral surface 1212 is sharpened. Then the user may hold the curet handle 1220 and rotate the curet to the position Y. Because the rubber wall 1264 may extend to the position 1265 when the curet rotates from position X to position Y, the lateral surface 1212 and the tip 1214 of the curet may be kept in contact with the abrasive area 1263 during the rotation of the curet, so that the lateral surface 1212 and the tip 1214 are sharpened. Then the user may hold the curet handle 1220 and continue rotating the curet to the position Z. Similarly, because the rubber wall 1264 may go back to the original position 1264 when the curet rotates from position Y to position Z, the tip 1214 and the lateral surface 1213 of the curet may be kept in contact with the abrasive area 1263 during the rotation of the curet, so that the tip 1214 and the lateral surface 1213 are sharpened. In this way, the whole lateral surface of the curet 1210, including the lateral surface 1212, 1213 and the tip 1214, may be sharpened.

In some embodiments, the apparatus includes a pivot in the base of the channel that stabilizes the orthopedic curet 1210 and facilitates pivoting the curet within the apparatus as the instrument is moved against the abrasive surface. In certain further embodiments, the pivot is within a channel groove that serves to guide the orthopedic curet along the channel while it is in the pivot. In certain embodiments, the pivot can rotate freely and slide down through the channel at the relief area 1265 on, for example, a rail from areas near location 95 to location 96 in apparatus 1250.

In another embodiment, by using a curet sharpening apparatus 1250 shown in FIG. 12B, the curet handle 1220 may be connected to a machine, so that the curet may be sharpened by automated rotation, and thus without a user's hand-held, manual operation.

Figure 13A:
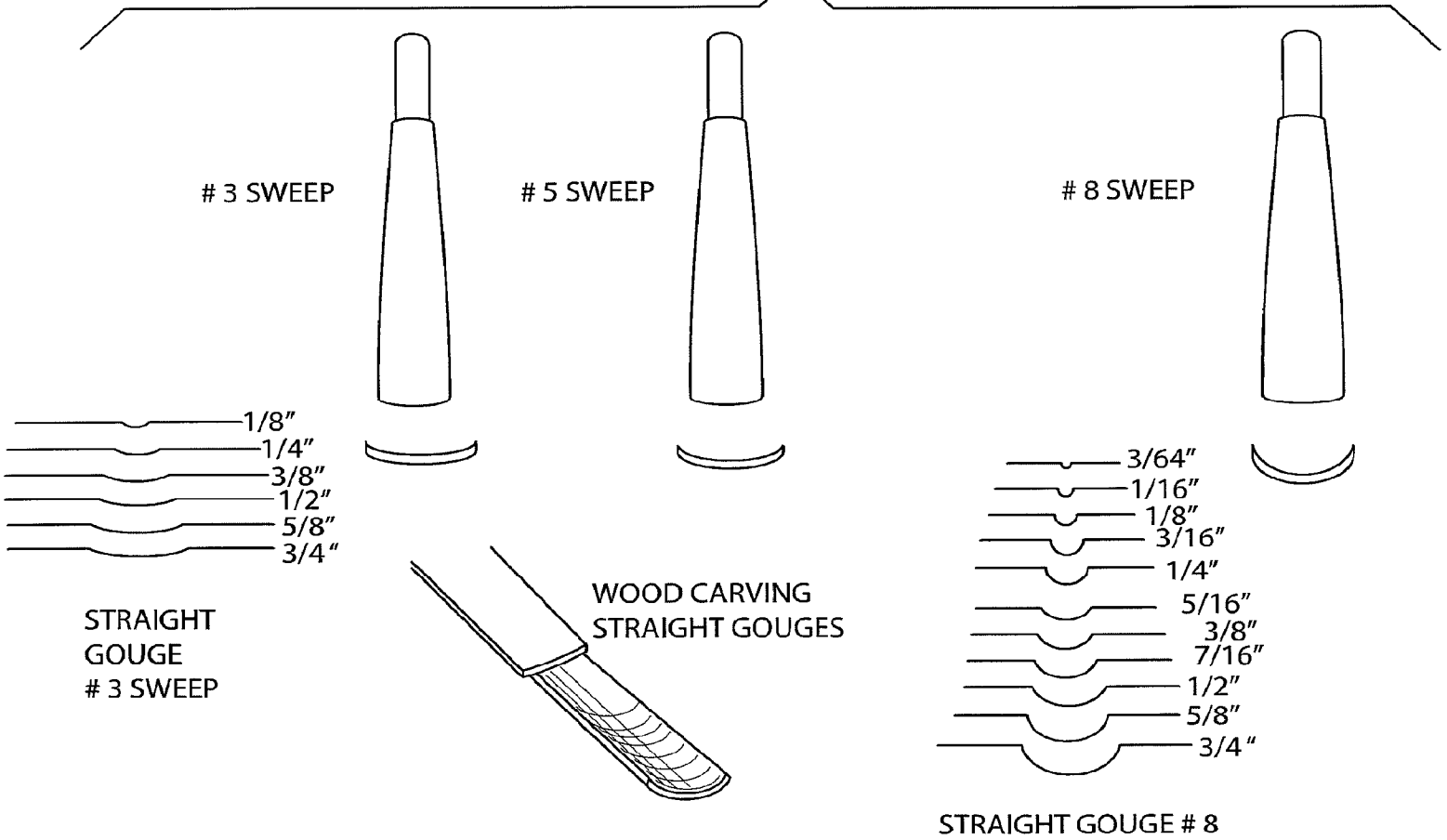
FIG. 13A shows examples of wood carving straight gouges.

FIG. 13A shows examples of wood carving straight gouges. Wood carving straight gouges may have blades of any number of different radiuses, such as, for example, 3/63", 1/16", 1/8", 3/16", 1/4", 5/16", 3/8", 7/16", 1/2", 5/8", 3/4", etc. Accordingly, in certain embodiments, the sharpening apparatus of the instant invention can be manufactured with different grooves corresponding to different gouge blade end shapes and tip sizes.

Figure 13B:
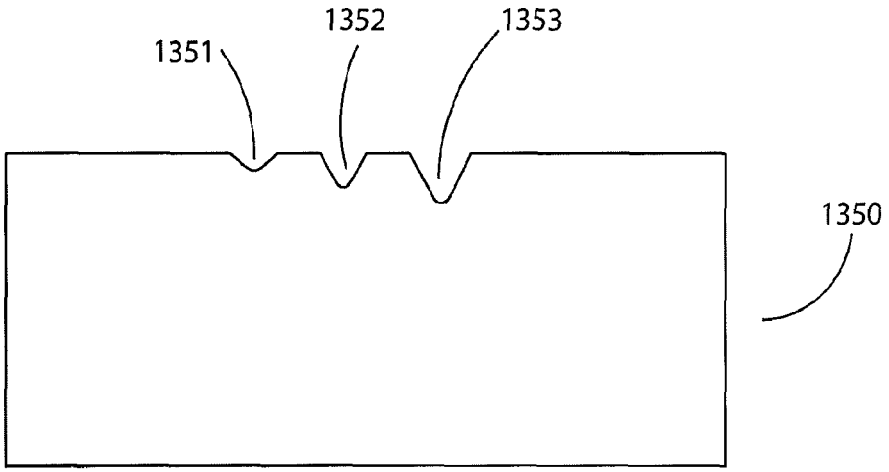
FIG. 13B illustrates an embodiment of a gouge sharpening apparatus.

FIG. 13B illustrates an embodiment of a gouge sharpening apparatus according to the instant invention. FIG. 13B shows a cross-sectional view of the gouge sharpening apparatus 1350. The gouge sharpening apparatus 1350 contains one or more channels or grooves with abrasive areas, for example, grooves 1351, 1352 and 1353, which are designed for different blade end shapes and tip sizes. Drawing the cutting edge of the gouge through a particular groove will impart with precision a particular shape to the end of the gouge.

In certain embodiments, the article of manufacture to be sharpened by an apparatus of the instant invention is a scissors or shears. An apparatus of the invention can sharpen, shape, and finish any type of scissors and shears, including hair scissors; fabric scissors; embroidery scissors; bandage scissors; cuticle, nail, and pedicure scissors; standard office and home scissors; kitchen scissors; and gardening shears, such as pruning shears. There are two halves to a pair of scissors; the upper and lower shear blade. The cutting edges on the upper and lower shear blades are the essential, sharply ground working parts of the scissors. The finer the cutting requirements on a pair of scissors (e.g., embroidery scissors), the more pointed and narrower the tip needs to be. In certain instances, when a shear blade becomes worn, such as the shear blades on a pair of hair scissors, the blade needs re-convexing to increase the function of the shear. Accordingly, in certain embodiments, an apparatus of the instant invention is configured to restore the convex edge of a hair shear to its original or desired shape.

Figure 14A:
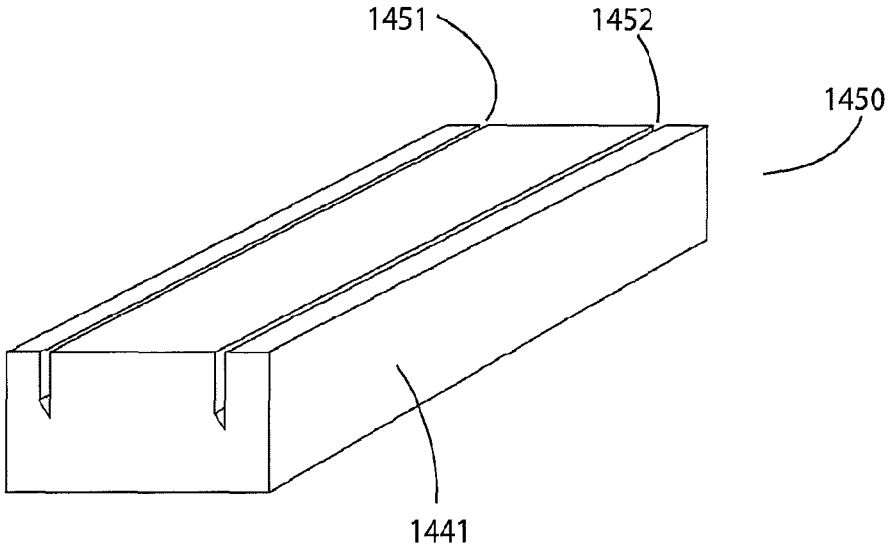
FIG. 14A is a perspective view of an example of a scissors sharpening apparatus.

FIG. 14A is a perspective view of an example of a scissors sharpening apparatus 1450. The scissors sharpening apparatus 1450 includes a block 1441 that may contain one or more channels or grooves, for example, grooves 1451 and 1452, which are designed for different blade end shapes and tip sizes. Drawing the cutting edge of the scissors through a particular groove will impart with precision a particular shape to the end of the scissors.

FIGS. 14B and 14C show perspective views of another example of a scissors sharpening apparatus 1470. The scissors sharpening apparatus 1470 includes two blocks 1443 and 1444 that are connected by the hinges 1421 and 1422. Each of the blocks 1443 and 1444 may contain one or more channels or grooves, for example, grooves 1453 and 1454 on block 1443 and grooves 1455 and 1456 on block 1444. The grooves 1453-1456 are designed for different blade end shapes and tip sizes. Drawing the cutting edge of the scissors through a particular groove will impart with precision a particular shape to the end of the scissors. Thus, the scissors may be pulled through the groove in the closed sharpening box as shown in FIG. 14C.

Figure 14D:
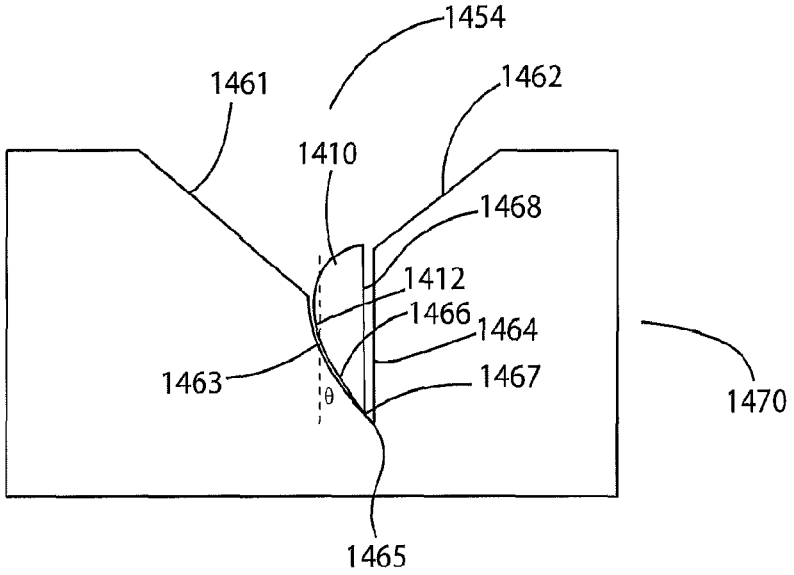
FIGS. 14D and 14E show cross-sectional views of a groove of the scissors sharpening apparatus shown in FIG. 14B.
Figure 14E:
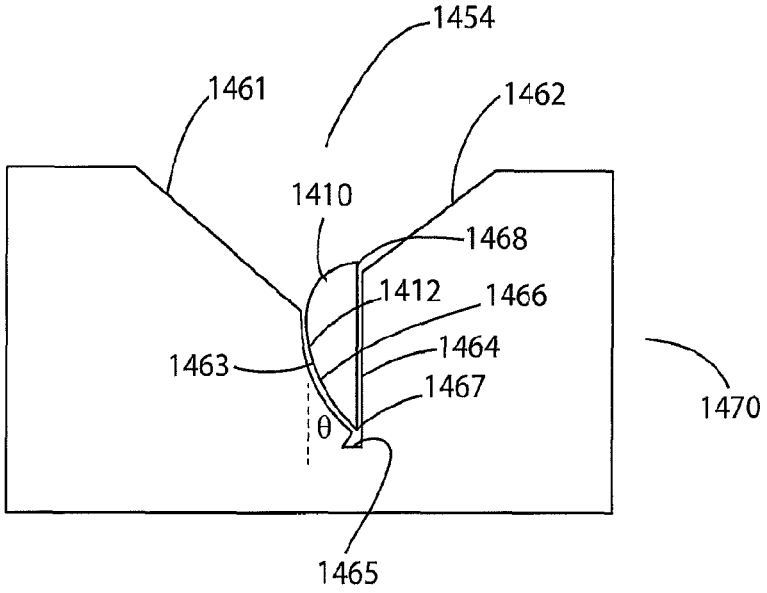

FIGS. 14D and 14E show a cross-sectional view of a groove, for example, 1454 of the scissors sharpening apparatus 1470 shown in FIG. 14B. A scissors blade 1410 is positioned in a groove 1454 of the scissors sharpening apparatus 1470. As shown in FIGS. 14D and 14E, the groove 1454 has relief areas 1461 and 1462 on each side of the groove, respectively. Two areas 1463 and 1464 are located below the relief areas 1461 and 1462, respectively, on each side of the groove 1454 and either 1463 or 1464 may be abrasive or non-abrasive. In the embodiment shown in FIG. 14D, area 1463 is abrasive and area 1464 is non-abrasive, with the area to be abraded 1466 and cutting edge 1467 of scissors blade 1410 contacting abrasive area 1463 of the sharpening apparatus. In the embodiment shown in FIG. 14E, area 1463 is non-abrasive and area 1464 is abrasive, with the flat side 1468 of scissors blade 1410 and the cutting edge 1467 of scissors blade 1410 contacting abrasive area 1464. The portion 1465 is a relief corresponding to the zones to remain unfinished and not projecting towards the inserted scissors blade 1410 and therefore incapable of contact with any surface of the scissors blade 1410. The relief portion 1465 may have a wide variety of cross-sectional side profiles, ranging from square to oval or elliptical. 1412 is the curvilinear surface of the scissors 1410 corresponding to an area of the scissors not to be abraded.

Figure 15A:
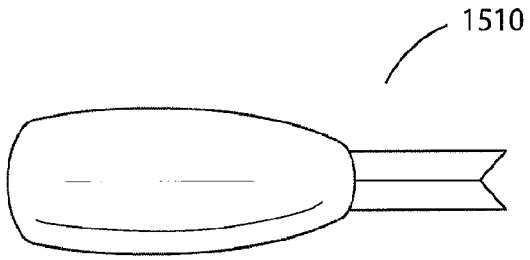
FIG. 15A shows examples of V-parting tool sharpening devices.

FIG. 15A shows an example of a V-parting tool sharpening device 1510. The V-parting tool may have blades with different degree angles, for example, ⅛", 3⁄16", ¼", etc. Accordingly, a sharpening apparatus of the instant invention can be manufactured with different grooves corresponding to the different blade end shapes and tip sizes.

Figure 15B:
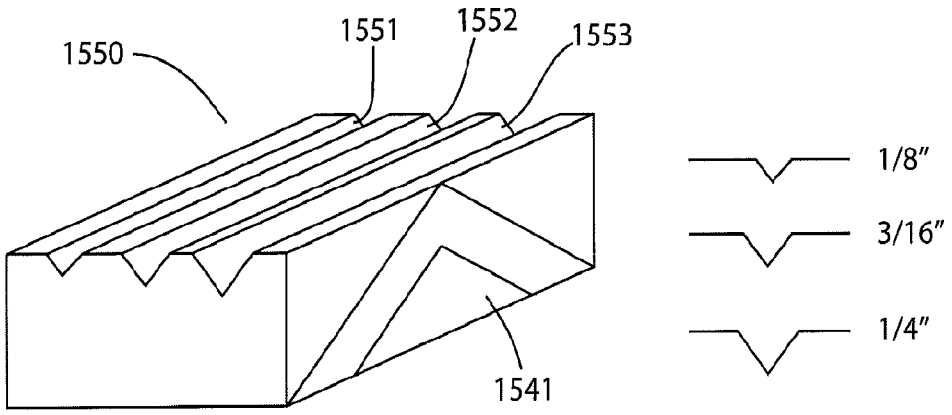
FIG. 15B shows a perspective view of an example of a V-parting tool sharpening apparatus.

FIG. 15B shows a perspective view of an example of the V-parting tool sharpening apparatus 1550. The V-parting tool sharpening apparatus 1550 includes a block 1541 that may contain one or more channels or grooves with abrasive areas, for example, grooves 1551, 1552, and 1553, which are designed for different blade end shapes and tip sizes. Drawing the cutting edge of the V-parting tool through a particular groove will impart with precision a particular shape to the end of the tool.

FIGS. 15C and 15D show perspective views of another example of a V-parting tool sharpening apparatus 1570. The V-parting tool sharpening apparatus 1570 includes two blocks 1542 and 1543 that are connected by the hinges 1521 and 1522. The block 1542 may contain one or more channels or grooves, for example, grooves 1554, 1555, and 1556. The block 1543 is a cover portion connected with the block 1542. The grooves 1554-1556 are designed for different blade end shapes and tip sizes. Drawing the cutting edge of the V-parting tool through a particular groove will impart with precision a particular shape to the end of the tool. Thus, the V-parting tool may be pulled through the groove in the closed sharpening box as shown in FIG. 15D.

In certain embodiments, the article of manufacture to be sharpened by an apparatus of the instant invention is a screw. An apparatus of the invention can sharpen, shape, and finish any type of screw, including screws having thread varieties selected from wood, machine, sheet metal, high-low, and self-tapping. Screws made from any kind of material are suitable for sharpening, shaping, and finishing in an apparatus of the invention, including screws made from steel, brass, aluminum, or nylon and with or without a finish, such as zinc plating, black oxide, or a non-stick coating. Likewise, an apparatus of the invention can be configured to sharpen, shape, and finish a screw of any diameter and length. In certain embodiments, the screw is an orthopedic screw or other screw for use in vivo.

Figure 16A:
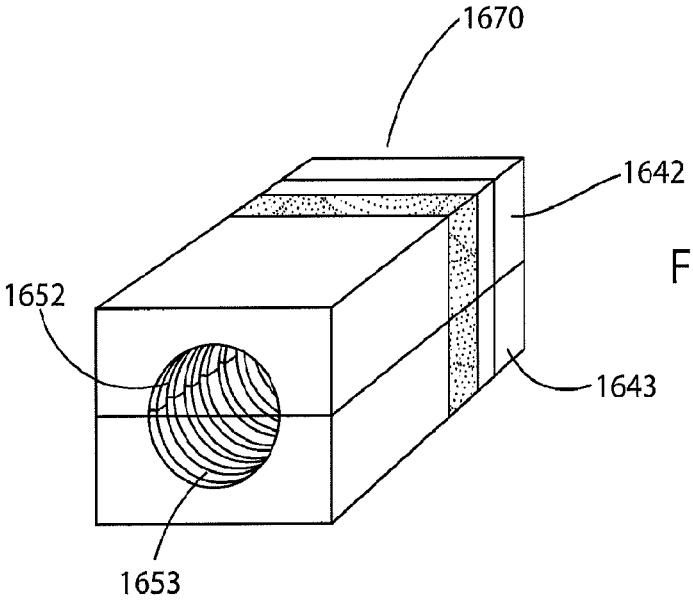
FIGS. 16A and 16B show perspective views of an example of a screw sharpening device 1670.
Figure 16B:
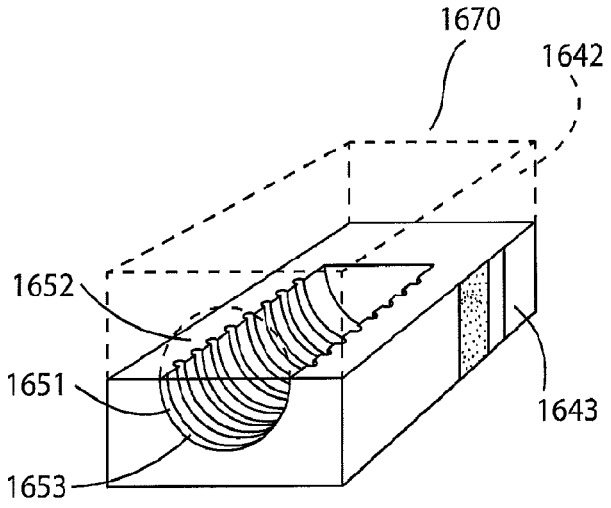
Figure 16C:
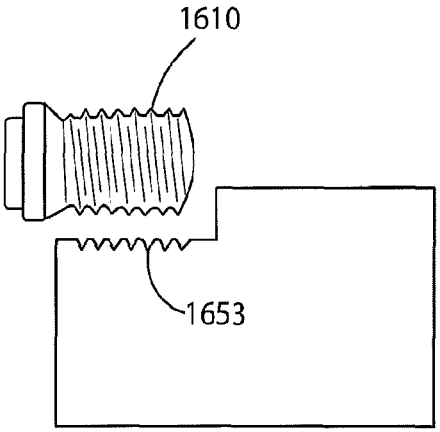
FIG. 16C shows a cross-sectional view of a groove of the screw sharpening apparatus shown in FIG. 16B.

FIGS. 16A and 16B show perspective views of an example of a screw sharpening device 1670. The screw sharpening apparatus 1670 includes two blocks 1642 and 1643. Each of the blocks 1642 and 1643 may contain one or more grooves with abrasive areas, for example, groove 1652 on block 1642 and groove 1653 on block 1643.

When sharpening the screw, as shown in FIG. 16B, the screw is positioned in the groove 1653 on the block 1643, then the block 1642 is positioned on the block 1643 so that the screw is located in the channel 1651 formed by the grooves 1652 and 1653. The grooves 1642 and 1643 have the same thread pattern corresponding to the thread on the screw. Therefore, as shown in 16C, when the screw 1610 is positioned in the groove 1653, rotating the screw along the threads will impart with precision a particular shape to the thread of the screw.

As used throughout the specification and claims, the term "abrasive surface" includes surfaces fabricated from sandpaper, emory cloth, diamond surfaces, steel wools, jeweler's rouge, liquid abrasives and all conventional and known abrasives in their various abrasive grades, ranging from coarse to very fine grit or particle size. Thus, the abrasive surfaces may be fabricated from materials which differ from or are identical to the material comprising the support means.

As will be appreciated, finishing process includes shaping, sharpening, surface roughness control for kitchen knives, lawn mower blades, orthopedic curettes, neurosurgical curettes, ice skates, wood planing instruments, gouges, saws, screws, and scissors.

It will be appreciated by those ordinarily skilled in the art that the foregoing brief description and the following detailed description are exemplary (i.e., illustrative) and explanatory of the subject matter as set forth in the present disclosure, but are not intended to be restrictive thereof or limiting of the advantages that can be achieved by the present disclosure in various implementations. Additionally, it is understood that the foregoing summary and ensuing detailed description are representative of some embodiments as set forth in the present disclosure, and are neither representative nor inclusive of all subject matter and embodiments within the scope as set forth in the present disclosure. Thus, the accompanying drawings, referred to herein and constituting a part hereof; illustrate embodiments of this disclosure, and, together with the detailed description, serve to explain principles of embodiments as set forth in the present disclosure.

The invention claimed is:

1. An apparatus for finishing a zone on the surface of a bladed article of manufacture, said surface comprising a plurality of adjacent and contiguous zones, comprising;

a support for a rigid abrasive surface supported thereon;

one or more channels supported on the support, each of the channels having a cross-sectional profile including at least one finishing area to finish an operative zone of the article that optimizes a clearance portion of the article, wherein the finishing area includes a contacting area and a non-contacting area, and wherein a finishing area angle $\theta$ of each finishing area of the cross-sectional profile is substantively the same as an optimal clearance angle $\beta$ of the article, wherein the apparatus is configured to position the operable zone of the article along the angle of the finishing area during sharpening, and and wherein the optimal clearance angle $\beta$ of the article is calculated according to rake angle $\alpha$ and blade angle $\gamma$ where $\beta=90°-\gamma$ is zero rake;

$\beta=90°-\gamma-\alpha$ is positive rake; and $\beta=90°-(\gamma-\alpha)=90°-\gamma+\alpha$ is negative rake.

2. The apparatus of claim 1, wherein each of the channels includes a pair of the finishing areas.

3. The apparatus of claim 1, wherein the abrasive surface further comprises a relief connecting the pair of finishing areas and being positioned below the pair of finishing areas, the relief corresponding to the zone or zones to remain unfinished.

4. The apparatus of claim 1, wherein the finishing area is a linear or curvilinear surface.

5. The apparatus of claim 1, wherein the support is a block.

6. The apparatus of claim 1, wherein the abrasive surface comprises aluminum oxide.

7. The apparatus of claim 1, wherein the support and the abrasive surface comprise the same materials or different materials.

8. The apparatus of claim 5, wherein the abrasive surface is an exposed surface of the support.

9. The apparatus of claim 1, wherein the finishing areas of the apparatus are configured to finish a bladed article of manufacture selected from the group consisting of: medical devices, kitchen knives, mower blades, dental curets, orthopedic curets, neurosurgical curets, wood planing instruments, gouges, saws, screws, and scissors.

10. The apparatus of claim 1, wherein the apparatus is configured to sharpen, shape, and restore the article to its original or desired clearance when the bladed article of manufacture exhibits wear from use.

11. The apparatus of claim 1, wherein the apparatus is configured to sharpen, shape, and create a desired manufacturing specification for the article of manufacture, wherein the specification is a desired clearance for the article.

12. The apparatus of claim 1, wherein the apparatus is configured to sharpen, shape, and finish a zone on the surface of the bladed article of manufacture to a desired level of surface smoothness or roughness on the cutting edge.

13. The apparatus of claim 3, further comprising a relief positioned above the sharpening areas.

14. The apparatus of claim 3, wherein the relief is curvilinear.

15. The apparatus of claim 9, wherein the finishing areas of the apparatus are configured to finish a bladed article of manufacture selected from dental curets, orthopedic curets, neurosurgical curets, and scissors.

16. The apparatus of claim 1, further comprising a pivot in the base of the channel, wherein the pivot is configured to stabilize the back or other non-finished surface of the article of manufacture as the operable zone of the article is moved along the angle of the finishing area during sharpening.

17. The apparatus of claim 16, wherein the pivot is configured within a groove in the channel such that the article of manufacture can be drawn through the channel along the groove while the article is stabilized in the pivot.

18. The apparatus of claim 1, wherein the apparatus comprises:

a guide configured to guide a bladed instrument at a predetermined angle through the apparatus.

19. The apparatus of claim 15, wherein the apparatus is configured to finish an orthopedic curet, wherein the apparatus comprises a block of hardened abrasive material designed to abrade the lateral surfaces of the orthopedic curet, one or more channels that contact the lateral surface of the orthopedic curet when it is inserted into the appropriate channel and drawn against the abrasive area, relief areas on each side of the channel corresponding to the zones to remain unfinished, and two abrasive areas located beneath the relief areas.

20. A method for finishing a zone on the surface of a bladed article of manufacture, said surface comprising a plurality of adjacent and contiguous zones, comprising:

positioning an operable zone of the article in one channel on a support for a rigid abrasive surface of the article; and drawing the article through the channel, wherein one or more channels are supported on the support, each of the channels having a cross-sectional profile including at least one finishing area to finish an operative zone of the article that optimizes a clearance portion of the article, wherein the finishing area includes a contacting area and a non-contacting area, and wherein finishing area angle θ of each finishing area of the cross-sectional profile is substantively the same as an optimal clearance angle β of the article, wherein the apparatus is configured to position the operable zone of the article along the angle of the finishing area during sharpening, and wherein the optimal clearance angle β of the article is calculated according to rake angle α and blade angle γ where $\beta=90°-\gamma$ is zero rake;

$\beta=90°-\gamma-\alpha$ is positive rake; and $\beta=90°-(\gamma-\alpha)=90°-\gamma+\alpha$ is negative rake.

21. An apparatus for finishing a zone on the surface of a an ice skate, said surface comprising a plurality of adjacent and contiguous zones, comprising;

a support for a rigid abrasive surface supported thereon;

one or more channels supported on the support, each of the channels having a cross-sectional profile including at least one finishing area to finish an operative zone of the article that optimizes a clearance portion of an ice skate blade, wherein the finishing area includes a contacting area and a non-contacting area, and wherein a finishing area angle θ of each finishing area of the cross-sectional profile is substantively the same as an optimal clearance angle p of the article, wherein the apparatus comprises a groove that includes a circular surface having radius R and a relief surface, and wherein the optimal clearance angle p of the article is measured between the circular surface R and the plane formed by two edges of the skate blade.

22. The apparatus of claim 21, wherein the apparatus is configured to finish an ice skate, wherein the apparatus comprises two abrasive walls, wherein the circular surface is non-abrasive and acts as a relief or guide to shape the lateral surfaces of the ice skate blade.

23. The apparatus of claim 21, wherein the circular surface is abrasive, and the relief acts as a non-abrasive guiding wall for selectively restoring the proper radius of hollow (ROH) of the ice skate blade.

24. The apparatus of claim 18 wherein the guide is adjustable.

25. The apparatus of claim 1 wherein the apparatus comprises one or more abrasive surfaces shaped to guide and finish the instrument surface.

* * * * *